US005632645A

United States Patent [19]

Love

[11] Patent Number: 5,632,645

[45] Date of Patent: May 27, 1997

[54] WIRE NUT WITH SELF LOCKING HOT WIRE INSERT

[76] Inventor: William Love, 3230 E. Quartz La., Apt. G4, Fullerton, Calif. 92831

[21] Appl. No.: 694,037

[22] Filed: Aug. 8, 1996

[51] Int. Cl.[6] ..... H01R 4/26

[52] U.S. Cl. ..... 439/441; 439/438; 174/87

[58] Field of Search ..... 439/441, 438, 439/439, 440; 174/87

[56] References Cited

U.S. PATENT DOCUMENTS

| | | | |
|---|---|---|---|
| 3,099,505 | 7/1963 | Schwartz | 439/439 |
| 4,978,315 | 12/1990 | Edgley et al. | 439/441 |
| 5,149,279 | 9/1992 | Kruse | 439/441 |
| 5,531,618 | 7/1996 | Market | 439/434 |

*Primary Examiner*—Neil Abrams
*Assistant Examiner*—T. C. Patel

[57] ABSTRACT

A new Wire Nut With Self Locking Hot Wire Insert for providing a connector which allows an electric wire to be safely removed from other wires for testing without disturbing the electrical bond needed by the branch wires. The inventive device includes an insert wire socket, a release wire socket, an insulating means, a conductive means, a retainer means and an insulating pad means. In use, an electrical supply 11 is electrically connected to an electrical circuit having any number of typical components such as a control means 15, like a switch 16, and branch circuit wires 14 which are typically held together by wire nuts 17. A typical application for this electrical circuit is in a house where a "neutral" wire 18 (usually white in insulation color) and the hot wire 12 (usually black in insulation color) are employed for transfer of electrical power from the electrical supply 11 to the electrical circuit. The inventive device is the self locking wire nut 13 which, referring to FIGS. 5 and 6, allows for easy wire assembly 50 or easy wire disassembly 60 with the additional use of a removal means 62 such as a flat head screw driver.

7 Claims, 3 Drawing Sheets

WIRE NUT WITH SELF LOCKING HOT WIRE INSERT

BACKGROUND OF THE INVENTION

1. Field of the Invention

The present invention relates to wire nut electrical connectors and more particularly pertains to a new Wire Nut With Self Locking Hot Wire Insert for providing a connector which allows an electric wire to be safely removed from other wires for testing without disturbing the electrical bond needed by the branch wires.

2. Description of the Prior Art

The use of wire nut electrical connectors is known in the prior art. More specifically, wire nut electrical connectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art wire nut electrical connectors include U.S. Pat. Nos. 5,112,252; 5,252,779; 4,684,195; 5,314,350; 4,415,215; and 4,133,596.

While these devices fulfill their respective, particular objectives and requirements, the aforementioned patents do not disclose a new Wire Nut With Self Locking Hot Wire Insert. The inventive device includes an insert wire socket, a release wire socket, an insulating means, a conductive means, a retainer means and an insulating pad means.

In these respects, the Wire Nut With Self Locking Hot Wire Insert according to the present invention substantially departs from the conventional concepts and designs of the prior art, and in so doing provides an apparatus primarily developed for the purpose of providing a connector which allows an electric wire to be safely removed from other wires for testing without disturbing the electrical bond needed by the branch wires.

SUMMARY OF THE INVENTION

In view of the foregoing disadvantages inherent in the known types of wire nut electrical connectors now present in the prior art, the present invention provides a new Wire Nut With Self Locking Hot Wire Insert construction wherein the same can be utilized for providing a connector which allows an electric wire to be safely removed from other wires for testing without disturbing the electrical bond needed by the branch wires.

The general purpose of the present invention, which will be described subsequently in greater detail, is to provide a new Wire Nut With Self Locking Hot Wire Insert apparatus and method which has many of the advantages of the wire nut electrical connectors mentioned heretofore and many novel features that result in a new Wire Nut With Self Locking Hot Wire Insert which is not anticipated, rendered obvious, suggested, or even implied by any of the prior art wire nut electrical connectors, either alone or in any combination thereof.

To attain this, the present invention generally comprises an insert wire socket, a release wire socket, an insulating means, a conductive means, a retainer means and an insulating pad means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Wire Nut With Self Locking Hot Wire Insert apparatus and method which has many of the advantages of the wire nut electrical connectors mentioned heretofore and many novel features that result in a new Wire Nut With Self Locking Hot Wire Insert which is not anticipated, rendered obvious, suggested, or even implied by any of the prior art wire nut electrical connectors, either alone or in any combination thereof.

It is another object of the present invention to provide a new Wire Nut With Self Locking Hot Wire Insert which may be easily and efficiently manufactured and marketed.

It is a further object of the present invention to provide a new Wire Nut With Self Locking Hot Wire Insert which is of a durable and reliable construction.

An even further object of the present invention is to provide a new Wire Nut With Self Locking Hot Wire Insert which is susceptible of a low cost of manufacture with regard to both materials and labor, and which accordingly is then susceptible of low prices of sale to the consuming public, thereby making such Wire Nut With Self Locking Hot Wire Insert economically available to the buying public.

Still yet another object of the present invention is to provide a new Wire Nut With Self Locking Hot Wire Insert which provides in the apparatuses and methods of the prior art some of the advantages thereof, while simultaneously overcoming some of the disadvantages normally associated therewith.

Still another object of the present invention is to provide a new Wire Nut With Self Locking Hot Wire Insert for providing a connector which allows an electric wire to be safely removed from other wires for testing without disturbing the electrical bond needed by the branch wires.

Yet another object of the present invention is to provide a new Wire Nut With Self Locking Hot Wire Insert which includes an insert wire socket, a release wire socket, an insulating means, a conductive means, a retainer means and an insulating pad means.

Still yet another object of the present invention is to provide a new Wire Nut With Self Locking Hot Wire Insert that offers a new electrical connector that removes hot wires from crowded connectors.

Even still another object of the present invention is to provide a new Wire Nut With Self Locking Hot Wire Insert that offers an easier and safer way to test for voltage on hot wires without disturbing branch circuits.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an enlarged cross sectional detail view of a self-locking wire insert being over-ridden with a tool such as a screw driver or the like.

DESCRIPTION OF THE PREFERRED EMBODIMENT

Figure 1:
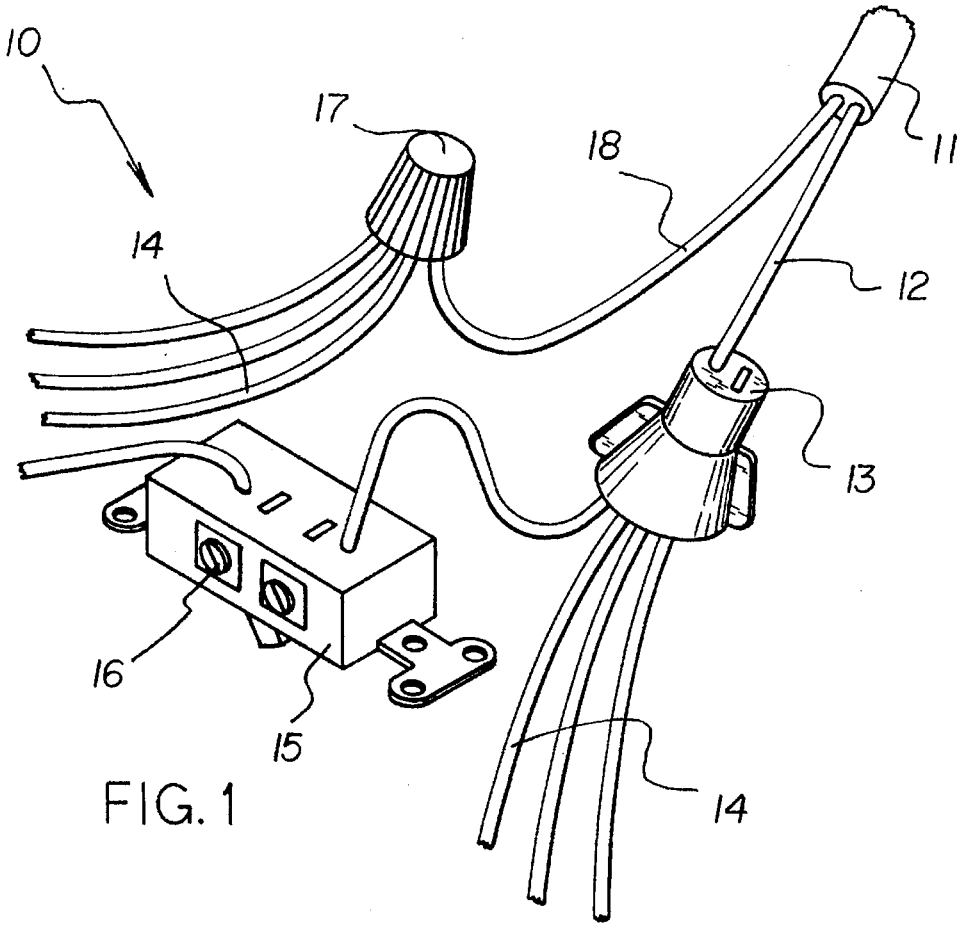
FIG. 1 is a right side perspective view of a system utilizing a new Wire Nut With Self Locking Hot Wire Insert according to the present invention.
Figure 2:
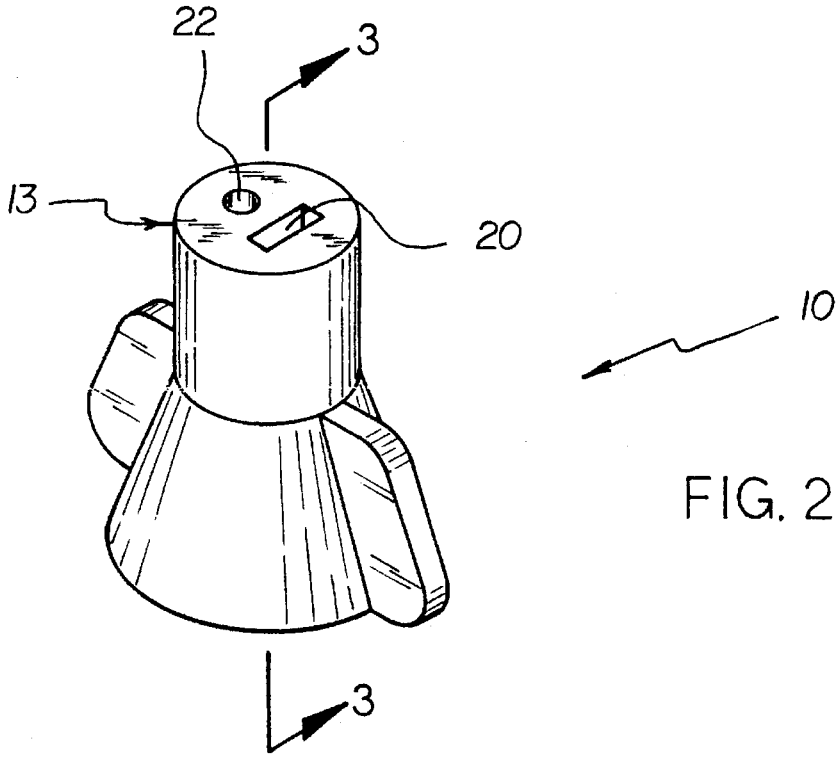
FIG. 2 is a right side perspective view of a new Wire Nut With Self Locking Hot Wire Insert according to the present invention.

With reference now to the drawings, and in particular to FIGS. 1 through 6 thereof, a new Wire Nut With Self Locking Hot Wire Insert embodying the principles and concepts of the present invention and generally designated by the reference numeral 10 will be described.

More specifically, it will be noted that the Wire Nut With Self Locking Hot Wire Insert 10 comprises an insert wire socket 22, a release wire socket 20, an insulating means 30, a conductive means 32, a spring retainer means 44, and an insulating pad means 42 where the insulating means 30 is a housing which holds the insert wire socket 22, the release wire socket 20, the conductive means 32, and the retainer means 44 and where the insert wire socket 22, the release wire socket 20, the conductive means 32, and the retainer means 44 are all electrically connected to one another and the insulating pad means 42 is fixedly fastened to the retainer means 44 and substantially prevents electrical contact therewith.

As best illustrated in FIGS. 1 through 6, it can be shown that the insulating means 30 is shaped similarly as any old and well known wire nut 17 and hence is generally conical in shape. The conductive means 32 is further defined as including a tapered screw thread 34 for receiving a plurality of branch circuit wires 14 and is encompassed by the insulating means 30. At an upper end of the tapered screw thread 34 is an integrally continuous extension protrusion which further defines and includes the insert wire socket 22 where the insert wire socket 22 is more specifically defined as an aperture within the integrally continuous extension protrusion.

The insulating means 30 further includes a vertical aperture and a horizontal aperture where the horizontal aperture retainably holds the spring retainer means 44 and the vertical aperture provides tool access to an upper section of the spring retainer means 44 and the upper section of the spring retainer means 44 is fixedly covered by the insulating pad means 42.

Figure 5:
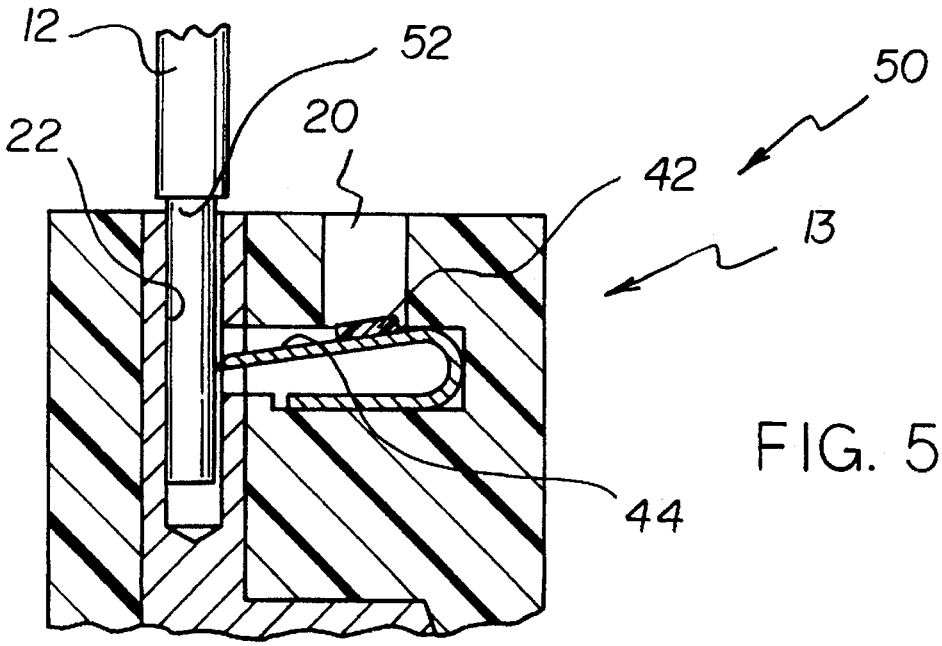
FIG. 5 is an enlarged cross sectional detail view of a self-locking wire insert with a wire inserted.
Figure 6:
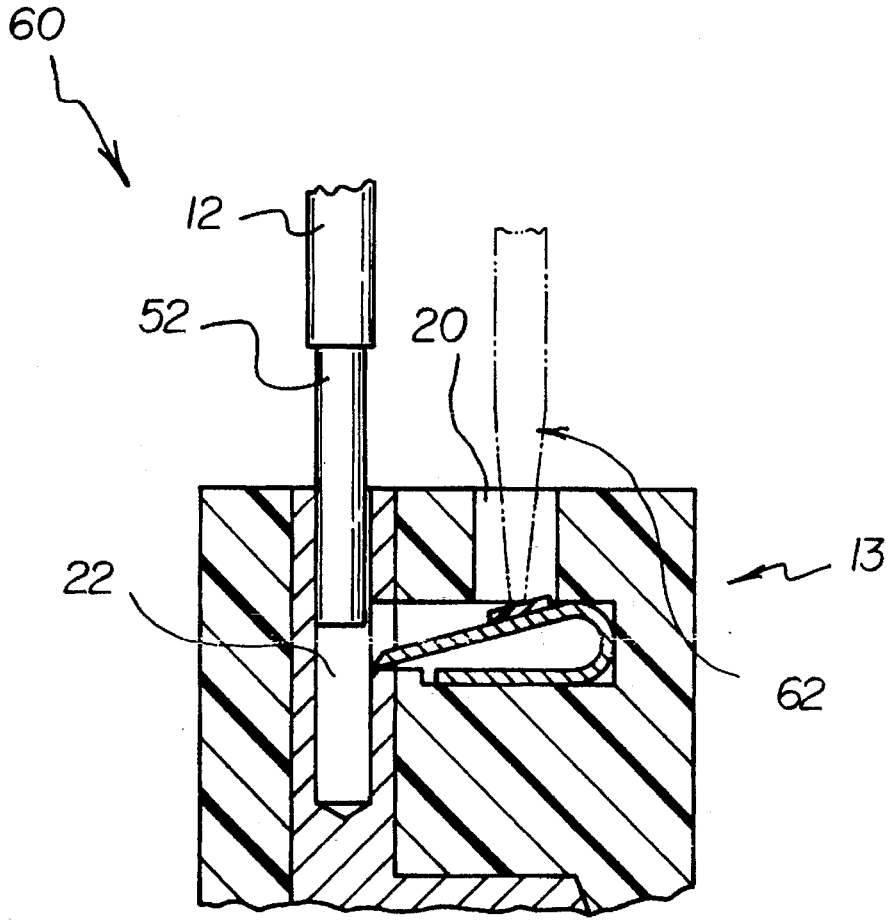
Figure 3:
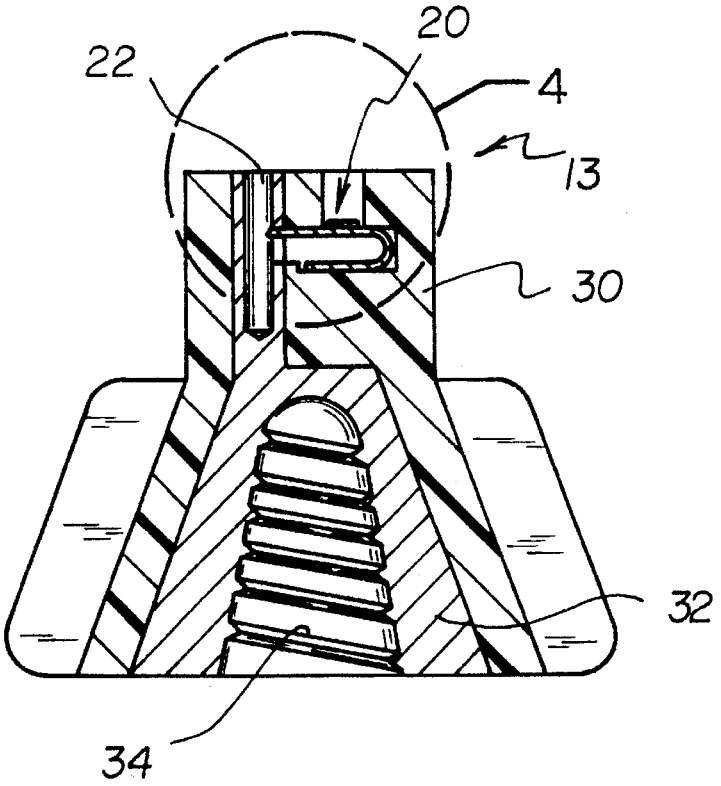
FIG. 3 is a cross sectional view taken along line 3—3 of FIG. 2.
Figure 4:
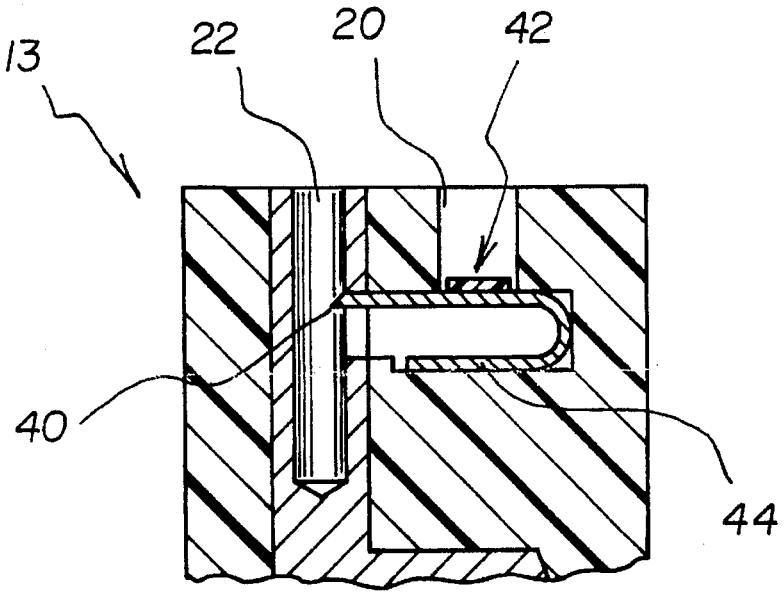
FIG. 4 is an enlarged cross sectional detail view of a self-locking wire insert.

The spring retainer means 44 further includes a sharp edge 40 at a protruding end of the spring retainer means 44 and the sharp edge 40 is flat on a side of the spring retainer means 44 facing the tapered screw thread 34 and is beveled from the opposite side of the spring retainer means 44 to the flat side. Referring to FIGS. 5 and 6, the spring retainer means 44 is spring biased to deflect downward toward the tapered screw thread 34 and the sharp edge 40 is shaped to slidingly allow a hot wire 12 to be slidingly inserted past the sharp edge 40 and by combination of spring bias and sharp edge 40, the hot wire 12 is self locked from disengagement.

The hot wire 12 is a typical electrically conductive wire with an insulation coating surrounding it and when the insulation is removed, a stripped wire 52 is exposed such that for the preferred embodiment, the spring retainer means 44 more particularly cuts into the hot wire 12 and the hot wire 12 is spring biasedly forced to make cylindrical contact with the insert wire socket 22.

The insulating means 30 the insert wire socket 22, the release wire socket 20, the conductive means 32, and the retainer means 44 together comprise and are redefined as a self locking wire nut 13.

In use, an electrical supply 11 is electrically connected to an electrical circuit having any number of typical components such as a control means 15, like a switch 16, and branch circuit wires 14 which are typically held together by wire nuts 17. A typical application for this electrical circuit is in a house where a "neutral" wire 18 (usually white in insulation color) and the hot wire 12 (usually black in insulation color) are employed for transfer of electrical power from the electrical supply 11 to the electrical circuit. The inventive device is the self locking wire nut 13 which, referring to FIGS. 5 and 6, allows for easy wire assembly 50 or easy wire disassembly 60 with the additional use of a removal means 62 such as a flat head screw driver.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wire nut with self locking hot wire insert comprising: an insert wire socket, a release wire socket, an insulating means, a conductive means, a spring retainer means, and an insulating pad means where the insulating means is a housing which holds the insert wire socket, the release wire socket, the conductive means, and the retainer means and where the insert wire socket, the release wire socket, the conductive means, and the retainer means are all electrically connected to one another and the insulating pad means is fixedly fastened to the retainer means and substantially prevents electrical contact therewith.

2. The wire nut with self locking hot wire insert of claim 1, wherein the insulating means is generally conical in shape and where the conductive means is further defined as including a tapered screw thread for receiving a plurality of branch circuit wires and is encompassed by the insulating means and where an upper end of the tapered screw thread is an integrally continuous extension protrusion which further defines and includes the insert wire socket where the insert wire socket is more specifically defined as an aperture within the integrally continuous extension protrusion.

3. The wire nut with self locking hot wire insert of claim 2, wherein the insulating means further includes a vertical aperture and a horizontal aperture where the horizontal aperture retainably holds the spring retainer means and the vertical aperture provides tool access to an upper section of the spring retainer means and the upper section of the spring retainer means is fixedly covered by the insulating pad means.

4. The wire nut with self locking hot wire insert of claim 3, wherein the spring retainer means further includes a sharp edge at a protruding end of the spring retainer means and the sharp edge is flat on a side of the spring retainer means facing the tapered screw thread and is beveled from the opposite side of the spring retainer means to the flat side and where the spring retainer means is spring biased to deflect downward toward the tapered screw thread and the sharp edge is shaped to slidingly allow a hot wire to be slidingly inserted past the sharp edge and by combination of spring bias and sharp edge, the hot wire is self locked from disengagement.

5. The wire nut with self locking hot wire insert of claim 4, wherein the hot wire is a typical electrically conductive wire with an insulation coating surrounding it and when the insulation is removed, a stripped wire is exposed and the spring retainer means cuts into the hot wire and the hot wire is spring biasedly forced to make cylindrical contact with the insert wire socket.

6. The wire nut with self locking hot wire insert of claim 5, wherein the insulating means the insert wire socket, the release wire socket, the conductive means, and the retainer means together comprise a self locking wire nut.

7. The wire nut with self locking hot wire insert of claim 6, where in use, an electrical supply is electrically connected to an electrical circuit having any number of typical components such as a control means and branch circuit wires which are typically held together by wire nuts and where a neutral wire and the hot transfer electrical power from the electrical supply to the electrical circuit and where the self locking wire nut allows for easy wire assembly or easy wire disassembly with the additional use of a removal means.

* * * * *